US009342940B2

(12) United States Patent
Xu et al.

(10) Patent No.: US 9,342,940 B2
(45) Date of Patent: May 17, 2016

(54) CASHBOX AND MONEY VALIDATOR USING THE SAME

(71) Applicant: SHANDONG NEW BEIYANG INFORMATION TECHNOLOGY CO., LTD., Shandong (CN)

(72) Inventors: Fang Xu, Shandong (CN); Jing Li, Shandong (CN); Jigang Zhang, Shandong (CN); Yong Yuan, Shandong (CN)

(73) Assignee: SHANDONG NEW BEIYANG INFORMATION TECHNOLOGY CO., LTD., Shandong (CN)

( * ) Notice: Subject to any disclaimer, the term of this patent is extended or adjusted under 35 U.S.C. 154(b) by 0 days.

(21) Appl. No.: 14/420,644

(22) PCT Filed: Aug. 26, 2013

(86) PCT No.: PCT/CN2013/082284

§ 371 (c)(1),
(2) Date: Feb. 9, 2015

(87) PCT Pub. No.: WO2014/032555

PCT Pub. Date: Mar. 6, 2014

(65) Prior Publication Data

US 2015/0221156 A1 Aug. 6, 2015

(30) Foreign Application Priority Data

Sep. 3, 2012 (CN) ..... 2012 1 0322566

(51) Int. Cl.
*G07F 7/04* (2006.01)
*G07D 11/00* (2006.01)
(Continued)

(52) U.S. Cl.
CPC ..... *G07D 11/0006* (2013.01); *B65H 29/46* (2013.01); *B65H 31/22* (2013.01);
(Continued)

(58) Field of Classification Search
CPC ..... B65H 2402/32; B65H 2701/1912; G07D 11/0012; G07D 11/0021; G07D 11/0027; G07D 11/009; G07D 11/0096; G07D 2211/00
USPC ..... 194/206, 342, 350; 271/3.12, 42, 128, 271/129, 145, 147
See application file for complete search history.

(56) References Cited

U.S. PATENT DOCUMENTS

| | | | | |
|---|---|---|---|---|
| 4,597,571 | A * | 7/1986 | Redding | B65H 1/025 271/150 |
| 6,719,120 | B2 * | 4/2004 | Kato | 194/206 |
| 8,151,967 | B2 * | 4/2012 | Kwak et al. | 194/351 |
| 2011/0006471 | A1 | 1/2011 | Nireki | |
| 2011/0198191 | A1 * | 8/2011 | Nireki | 194/206 |

FOREIGN PATENT DOCUMENTS

| | | |
|---|---|---|
| CN | 2490134 Y | 5/2002 |
| CN | 201035640 Y | 3/2008 |

(Continued)

OTHER PUBLICATIONS

International Search Report in International Application No. PCT/CN2013/082284 mailed on Dec. 5, 2013 in 3 pages.

*Primary Examiner* — Mark Beauchaine
(74) *Attorney, Agent, or Firm* — Knobbe, Martens, Olson & Bear, LLP

(57) ABSTRACT

A cashbox and a money validator using the same, wherein the cashbox includes a box body, a partition for separating an inner space of the box body into a storage space and a temporary storage space that are horizontally arranged, a supporting plate assembly located inside the storage space, and a currency pressing assembly for pressing a paper currency in the temporary storage space into the storage space; further includes a sliding plate assembly located inside the storage space for supporting the paper currency, wherein the sliding plate assembly includes a sliding plate, and a plurality of rolling bodies located between the sliding plate and a bottom wall of the box body; wherein the sliding plate contacts with an end face of the paper currency, and can move back and forth along a stacking direction of the paper currency.

16 Claims, 8 Drawing Sheets

(51) Int. Cl.
*B65H 29/46* (2006.01)
*B65H 31/22* (2006.01)

(52) U.S. Cl.
CPC ..... *G07D11/0012* (2013.01); *G07D 11/0021* (2013.01); *B65H 2402/32* (2013.01); *B65H 2405/211* (2013.01); *B65H 2701/1912* (2013.01); *G07D 11/0096* (2013.01)

(56) References Cited

FOREIGN PATENT DOCUMENTS

| | | | |
|---|---|---|---|
| CN | 101751715 | A | 6/2010 |
| JP | 2004/013201 | A | 1/2004 |

* cited by examiner

CASHBOX AND MONEY VALIDATOR USING THE SAME

CROSS-REFERENCE TO RELATED APPLICATIONS

This application is the U.S. National Phase application under 35 U.S.C. §371 of International Application PCT/CN2013/082284, filed Aug. 26, 2013, which claims priority to Chinese Disclosure Patent Application No. 201210322566.7, entitled "Cashbox and Money Validator Using The Same", filed with State Intellectual Property Office on Sep. 3, 2012. The disclosure of each of these prior applications is incorporated by reference in its entirety.

TECHNICAL FIELD OF THE INVENTION

The disclosure relates to a cashbox and money validator using the same.

BACKGROUND OF THE INVENTION

The money validator is an essential assembly of a self-service terminal equipment, such as a self-service vending machine, a self-service ticket machine, and a Cash Deposit Machine. The money validator includes a currency recognition mechanism for validating the authenticity of paper currency and a cashbox for storing genuine currency. Wherein, the currency recognition mechanism judges the authenticity of paper currency according to the obtained information about the features of the paper currency. When the currency recognition mechanism judges the paper currency as genuine currency, the paper currency is transferred to the cashbox and stored.

FIG. 1 is a structure view of a general cashbox. The structure of the cashbox is disclosed in US patent US20110006471A1, the disclosure of which is incorporated herein in its entirety by reference. As shown in FIG. 1, inside the cashbox, a pressing plate 115 presses paper currency, which entered a temporary storage space 108 and is vertically placed, on the supporting plate 105 through an opening on a partition 110. After the pressing plate 115 is reset, the paper currency is pressed between the partition 110 and the supporting plate 105 tightly under the action of a compression spring 106. In addition, in FIG. 1, a reference number 100A refers to a side wall of a box body, a reference number 102*a* refers to a front wall of the box body, and a reference 101 refers to a handle of the box body.

Since an end face of the paper currency slides back and forth along the surface of the bottom surface of the cashbox when the paper currency is pressed each time, as more and more paper currency is pressed into the cashbox, the frictional force between the end face of the paper currency and the bottom wall of the cashbox will become larger and larger, so that the load of the driving mechanism of a currency pressing assembly is increased, which usually causes the paper currency being unable to be pressed into the cashbox, thus reducing the reliability to press the currency.

SUMMARY OF THE INVENTION

The purpose of the disclosure is to provide a cashbox with low load and high reliability, and further to provide a money validator using the cashbox.

To this end, according to an aspect of the disclosure, it provides a cashbox including a box body, a partition for separating an inner space of the box body into a storage space and a temporary storage space that are arranged horizontally, a supporting plate assembly located inside the storage space, and a currency pressing assembly for pressing a paper currency in the temporary storage space into the storage space, further including: a sliding plate assembly located inside the storage space for supporting the paper currency, wherein the sliding plate assembly includes a sliding plate, and a plurality of rolling bodies located between the sliding plate and a bottom wall of the box body; wherein the sliding plate contacts with an end face of the paper currency, and can move back and forth along a stacking direction of the paper currency.

Further, a guide structure linked up with each other for transiting the paper currency are provided between the sliding plate and the bottom wall.

Further, the guide structure includes a plurality of slots arranged at one end of the sliding plate, and a plurality of inserting plates provided on the bottom wall and capable of being inserted into and matched in one-to-one correspondence with the plurality of slots.

Further, the supporting plate assembly includes a supporting plate, and an elastic element partially pressing the supporting plate toward the partition; and the currency pressing assembly includes a pressing plate, and a scissors type driving assembly for driving the pressing plate, wherein an opening for the pressing plate to pass through is provided on the partition.

Further, one of the sliding plate and the bottom wall is provided with a limit guide groove extending along the stacking direction of the paper currency, and the other of the sliding plate and the bottom wall is provided with a guide post inserted into and matched with the limit guide groove.

Further, the guide post is provided with a screw which limits the position of the sliding plate relative to the bottom wall.

Further, the bottom wall is a box door of the box body which can be opened or closed, and the sliding plate assembly is always kept on the box door.

Further, the rolling body is a ball or roller, and the bottom wall is provided with a base for accommodating the ball or roller.

According to another aspect of the disclosure, it provides a money validator, including a frame, a currency recognition mechanism and a cashbox supported on the frame, wherein the cashbox is a cashbox according to the above described.

Further, the frame includes a left side wall, a right side wall, a base plate located between the left side wall and the right side wall, an intermediate partition, and a top wall, the currency recognition mechanism is provided between the top wall and the intermediate partition, and the cashbox is provided between the base plate and the intermediate partition.

The cashbox provided by the disclosure includes a box body, a partition for separating an inner space of the box body into a temporary storage space and a storage space, a currency pressing assembly, a sliding plate assembly, and a supporting plate assembly. The sliding plate assembly is provided at the bottom of the storage space and includes a sliding plate and rolling bodies, wherein the sliding plate assembly is used to support the stacked paper currency, and can move along a stacking direction of the paper currency. The rolling bodies are used to support the sliding plate. A guide structure for guiding the paper currency to transit smoothly is provided between the sliding plate and the bottom wall. During the paper currency is continuously pressed into the storage space, as the stack height of the paper currency increases, the paper currency may be supported on the sliding plate and slide along with the sliding plate relative to the bottom wall, and the rolling body converts a sliding friction into a rolling friction. Therefore, a load of a currency pressing assembly driving mechanism is reduced, and the currency pressing reliability is improved.

In addition to the objects, features and advantages described above, the other objects, features and advantages of the disclosure will be further described in detail in conjunction with the accompanying drawings.

BRIEF DESCRIPTION OF THE DRAWINGS

The accompanying drawings, which constitute a part of this application and serve to provide a further understanding of the disclosure illustrate the preferred embodiments of the disclosure, and together with the description serve to explain the principles of the disclosure. In the drawings.

REFERENCE NUMERALS

Figure 1:
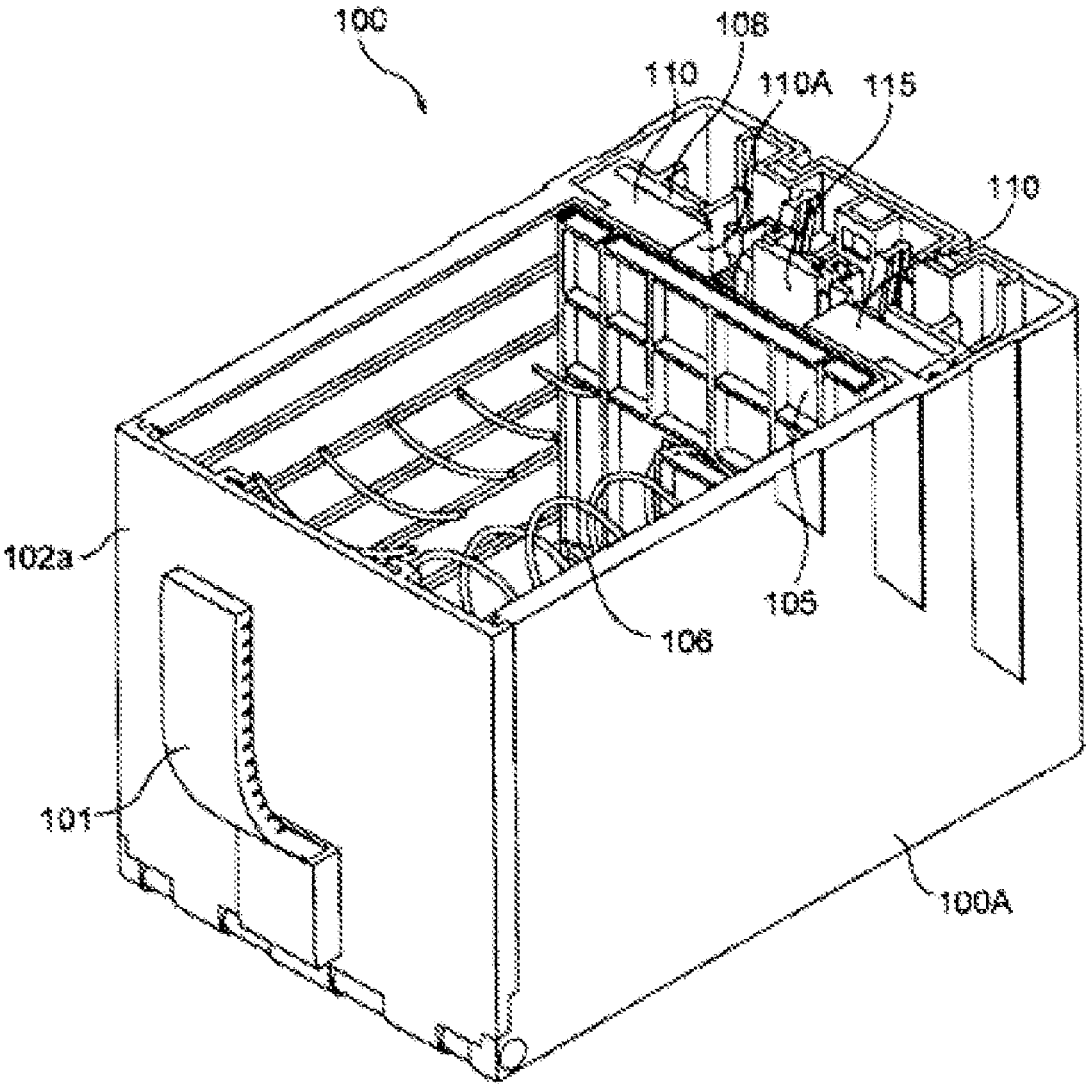
FIG. 1 is a structural view of a general cashbox.

8 box body
1 currency pressing assembly
2 sliding plate assembly
3 supporting plate assembly
3 top wall
81 bottom wall
82 right side wall
83 front wall
85 back wall
861 opening
86 partition
11 pressing plate
12 driving assembly
21 sliding plate
22 rolling body assembly
31 supporting plate
32 elastic element
221 rolling body
222 base
821 guide post
211 limit guide groove
212 slot
822 inserting plate
100 currency recognition mechanism
200 cashbox
300 frame
301 left side wall
302 right side wall
303 top wall
304 base plate
305 intermediate partition

DETAILED DESCRIPTION OF THE EMBODIMENTS

The embodiments of the disclosure will be described below in detail in conjunction with the accompanying drawings, but the disclosure may be implemented in many different ways defined and covered by Claims.

Figure 2:
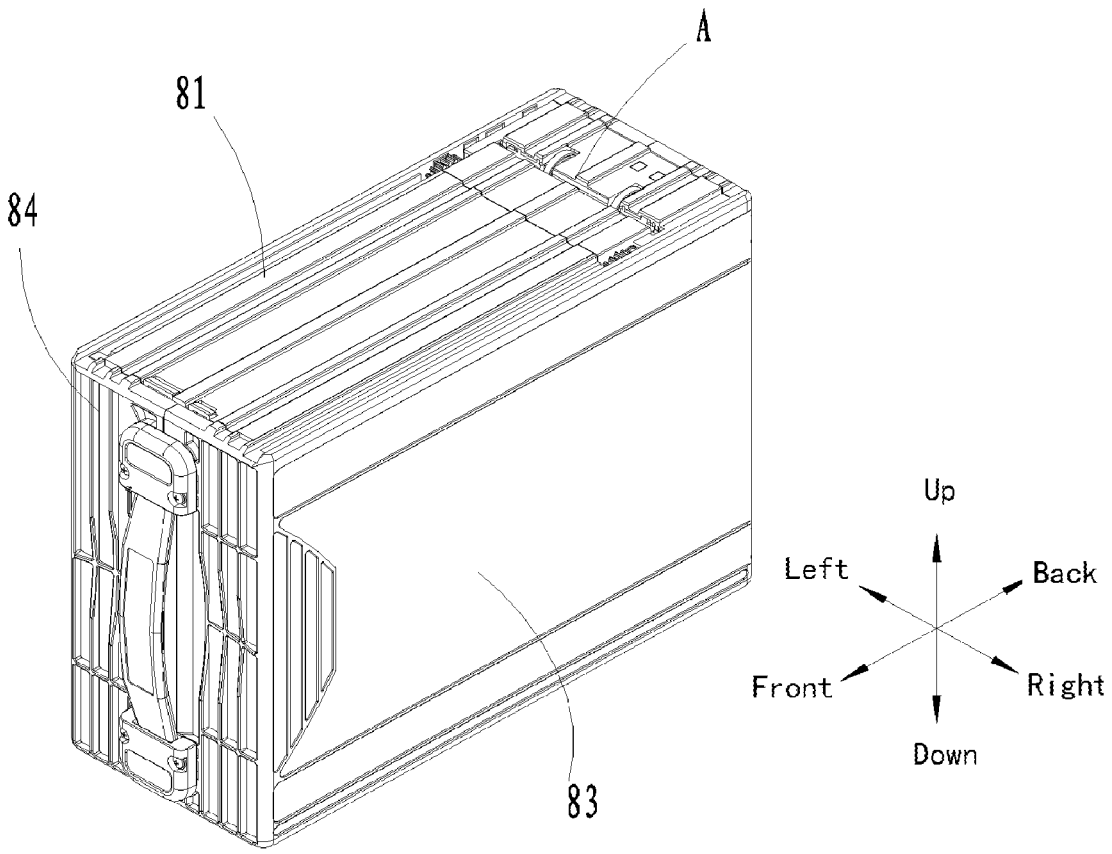
FIG. 2 is a structural axonometric view of a cashbox according to an embodiment of the disclosure.
Figure 3:
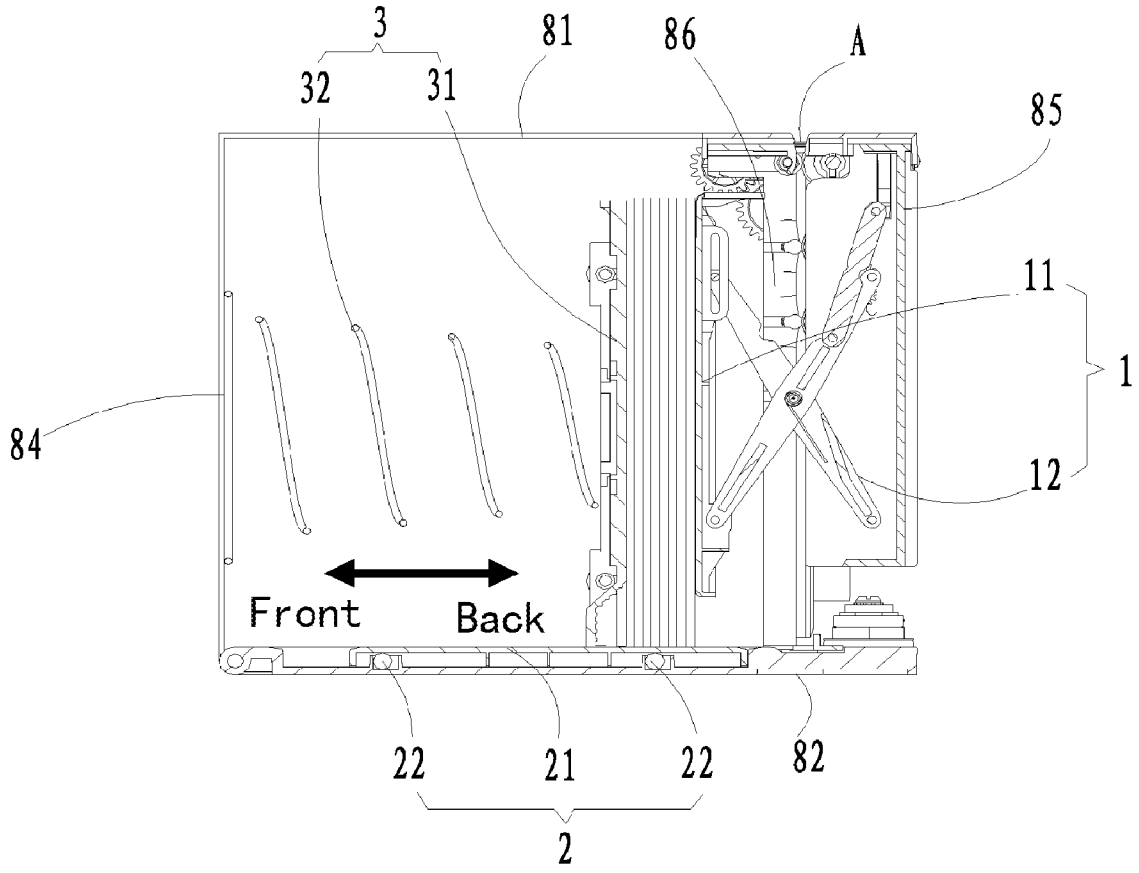
FIG. 3 is a structural cross-section view of a cashbox in a currency pressing state according to an embodiment of the disclosure.
Figure 4:
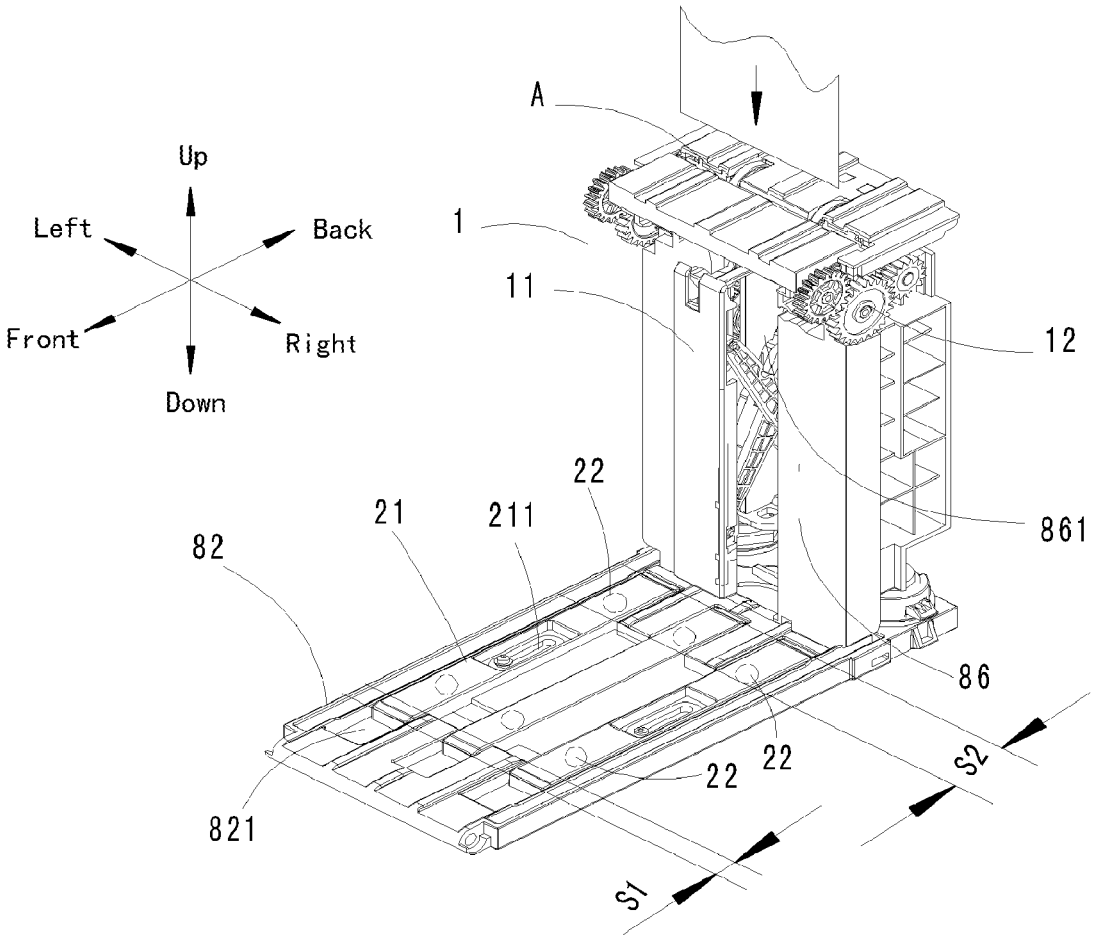
FIG. 4 is a partial axonometric view of a cashbox according to an embodiment of the disclosure.

FIG. 2 is a structural axonometric view of a cashbox according to an embodiment of the disclosure. FIG. 3 is a structural cross-section view of a cashbox according to an embodiment of the disclosure. FIG. 4 is a partial axonometric view of a cashbox according to an embodiment of the disclosure. As shown in FIG. 2 to FIG. 4, the cashbox includes a box body 8, a currency pressing assembly 1, a sliding plate assembly 2, and a supporting plate assembly 3.

The box body 8 is cuboid structure, including a top wall 81, a bottom wall 82, a left side wall (not shown in the figure), a right side wall 83, a front wall 84, and a back wall 85, wherein the top wall 81 and the bottom wall 82 are parallel to each other and spaced apart at a predetermined distance, the left side wall and the right side wall 83 are parallel to each other and spaced apart at a predetermined distance, the front wall 84 and the back wall 85 are parallel to each other and spaced apart at a predetermined distance, a partition 86 is provided between the front wall 84 and the back wall 85, the partition 86 is vertically connected with the top wall 81 and the bottom wall 82, an opening 861 is provided on the partition 86, the length of the opening 861 extends along a height direction (that is, an up and down direction as shown in FIG. 2) of the box body 8, the length of the opening 861 is greater than that of the paper currency, and width of the opening 861 is less than that of the paper currency. The partition 86 divides the box body 8 into a temporary storage space for accommodating a single sheet of paper currency and a storage space for accommodating stacked paper currency, and the temporary storage space and the storage space are arranged horizontally. Wherein, the height of each of the temporary storage space and the storage space is adapted to the width of the paper currency, and the length of the storage space extends along a stacking direction of the paper currency and the storage space may accommodate paper currency with set amount of sheets.

In the embodiment, the top wall 81, the bottom wall 82, the partition 86 and the back wall 85 together constitute the temporary storage space for temporarily accommodate the paper currency. The top wall 81, the bottom wall 82, the left side wall, the right side wall 83, the front wall 84 and the partition 86 together constitute the storage space for accommodating the paper currency. An inlet A is provided on the top wall 81 of the cashbox 8. The inlet A is communicated with the temporary storage space. The paper currency enters the temporary storage space from the inlet A, and then is pressed into the storage space from back to front by the pressing plate 11 of the currency pressing assembly 1.

It should be noted that, in other embodiments of the disclosure, the top wall 81, the bottom wall 82, the left side wall, the right side wall 83, the partition 86 and the back wall 85 together constitute the storage space for accommodating the paper currency. The top wall 81, the bottom wall 82, the partition 86 and the front wall 84 together constitute the temporary storage space for temporarily accommodate the paper currency. At this time, the paper currency is pressed into the storage space from front to back by the pressing plate 11 of the currency pressing assembly 1.

The currency pressing assembly 1 is located within the temporary storage space of the paper currency, connected with an inner surface of the front wall 84 or back wall 85 of the box body 8 for pressing the paper currency entered from the inlet A into the storage space into the temporary storage space. In the embodiment, the currency pressing assembly 1 is connected with the inner surface of the back wall 85 of the box body 8. The currency pressing assembly 1 includes a pressing plate 11 and a driving assembly 12, wherein the width of the pressing plate 11 is adapted to the width of the opening 861 on the partition 86, the height of the pressing plate 11 is less than the height of the opening 861 on the partition 86, the pressing plate 11 is connected with the driving assembly 12 in a transmission way, and may move back and forth along the stacking direction of the paper currency under the driving of the driving assembly 12. When the cashbox is in a waiting state, the pressing plate 11 and the partition 86 are spaced apart from a predetermined distance to constitute a paper feeding passage. One end of the paper feeding passage is communicated with the inlet A, that is, the paper currency is located between the partition 86 and the pressing plate 11 when entering the paper feeding passage from the inlet A. When the cashbox is in a currency pressing state, the pressing plate 11 moves along the stacking direction of the paper currency under the driving of the driving assembly 12, and the pressing plate 11 may pass through the opening 861 on the partition 86 and then enter the storage space to press the paper currency between the partition 86 and the pressing plate 11 into the inside of the storage space.

Figure 5:
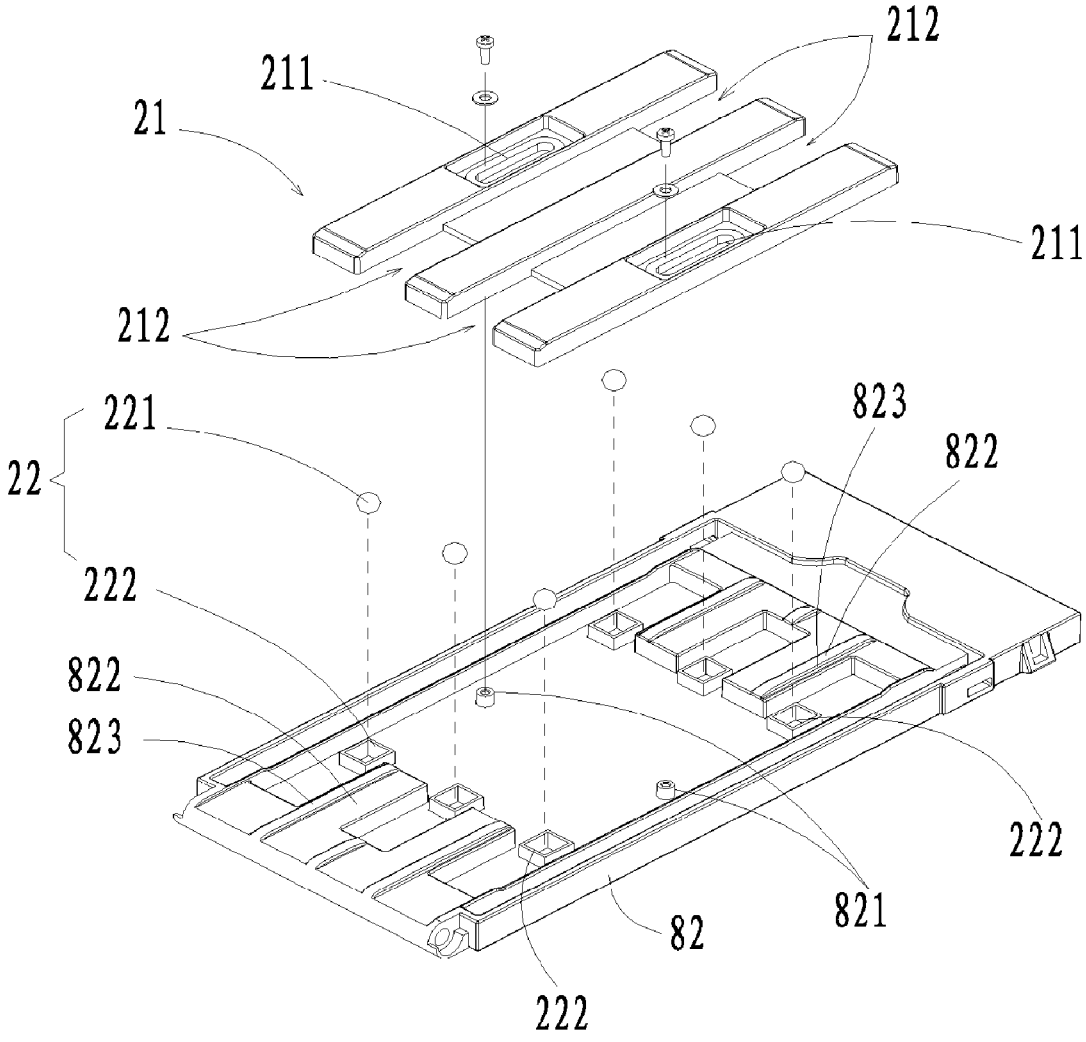
FIG. 5 is an exploded view of a sliding plate assembly of a cashbox according to an embodiment of the disclosure.

FIG. 5 is an exploded view of a sliding plate assembly of a cashbox according to an embodiment of the disclosure. The sliding plate assembly 2 is located within the storage space of the box body 8, and movably connected with the upper surface of the bottom wall 82 of the box body 8 for supporting the stacked paper currency. As shown in FIG. 5, the sliding plate assembly 2 includes a sliding plate 21 and at least three sets of rolling body assemblies 22. Wherein, the sliding plate 21 is used to support the stacked paper currency, and the rolling body assembly 22 is used to support the sliding plate 21, so that the sliding plate 21 may move relative to the bottom wall 82.

Specifically, the sliding plate assembly 2 includes at least three sets of rolling body assemblies 22, each of which is provided on the upper surface of the bottom wall 82 of the box body 8. Rolling bodies 221 of each rolling body assembly 22 constitute a plane for supporting the sliding plate 21. The rolling body assembly 22 includes a rolling body 221 and a base 222, wherein the base 222 in a shape of barrel for accommodate the rolling body 221 is fixedly connected with the upper surface of the bottom wall 82 of the box body 8. The rolling body 221 is placed within the base 222, rolls along the stacking direction of the paper currency. The rolling body 221 may be a ball or a roller. When the rolling body 221 is a roller, the axis of the roller is provided vertical to the stacking direction of the paper currency. Thus, the roller may move along the stacking direction of the paper currency when rolling around its own axis. In the embodiment, the sliding plate assembly 2 includes six sets of rolling body assemblies 22, which are divided into three columns in pairs, and the rolling body 221 is a ball.

The sliding plate 21 is located between the left side wall and the right side wall 83 and supported by the rolling body 221. The width of the sliding plate 21 is adapted to the width of the paper currency (i.e., the width of the storage space), and the length of the sliding plate 21 extends along the stacking direction of the paper currency. Under the support of the rolling body 221, the upper surface of the sliding plate 21 is higher than that of the bottom wall 82 of the box body. The length of the sliding plate 21 is less than that of the storage space of the box body 8. When the pressing plate 11 enters the storage space, the rolling body 221 may be driven by the sliding plate 21 to roll around its own axis. The sliding plate 21, under the restriction of the left side wall and right side wall 83 of the box body 8, may only move along the length direction of the storage space relative to the bottom wall 82. In the embodiment, the length of the sliding plate 21 is less than the distance between the inner surfaces of the front wall 84 and the partition 86 of the box body 8.

As shown in FIG. 3, the supporting plate assembly 3 is located inside of the storage space of the box body 8 and used to press the paper currency entered by pressing of the currency pressing assembly 1 on the partition 86 or the pressing plate 11, so that the paper currency entered by pressing one by one is always stacked closely in order. The supporting plate assembly 3 includes a supporting plate 31 and an elastic element 32, wherein the elastic element 32 is placed inside the storage space of the box body 8 along the stacking direction of the paper currency, and may stretch along the stacking direction of the paper currency. One end of the elastic element is fixedly connected with the inner surface of the front wall 84 or the back wall 85, and the other end is connected with the supporting plate 31.

In the embodiment, one end of the elastic element 32 is fixedly connected with the inner surface of the front wall 84 of the box body 8. The supporting plate 31 is located between the top wall 81 of the box body 8 and the sliding plate 21, and supported by the elastic element 32. The width of the supporting plate 31 is adapted to the width of the storage space, and the height of the supporting plate 31 is less than the distance between the lower surface of the top wall 81 of the box body 8 and the upper surface of the sliding plate 21. Under the action of the elastic element 32, the supporting plate 31 always tends to move in the direction close to the partition 86. Under the action of the elastic element 32, when the pressing plate 11 passes through the opening 861 on the partition 86 and then enters the inside of the storage space and the supporting plate 31 presses the paper currency on the pressing plate 11 closely. When the pressing plate 11 leaves the storage space, the supporting plate 31 presses the paper currency on the partition 86 closely.

Further, a guide post 821 is provided on one of the bottom wall 82 of the box body 8 and the sliding plate 21. A threaded hole is provided on the end face of the guide post 821. A limit guide groove 211 is provided on the other of the bottom wall 82 of the box body 8 and the sliding plate 21. When the sliding plate 21 is placed on the bottom wall 82, the guide post 821 is inserted into and matched with the limit guide groove 211, and threaded connected with the threaded hole on the guide post 821 by a fastener such as a screw, etc, so that the position of the sliding plate 21 relative to the bottom wall 82 along the height direction of the storage space may be limited. In the embodiment, the guide post 821 is provided on the upper surface of the bottom wall 82, and the axis of the guide post 821 extends along the height direction of the storage spaces. The limit guide groove 211 is provided on the sliding plate 21, the length of the limit guide groove 211 extends along the stacking direction of the paper currency, and the width of the limit guide groove 211 is adapted to the outer diameter of the guide post 821.

Further, a guide structure linked up with each other for transiting the paper currency are provided between the sliding plate 21 and the bottom wall 82. Preferably, the guide structure includes a plurality of slots 212 provided on one of the sliding plate 21 and the bottom wall 82 of the box body 8, and a plurality of inserting plates 822 provided on the other of the sliding plate 21 and the bottom wall 82 of the box body 8, both of them extending along the stacking direction of the paper currency. When the sliding plate 21 is placed on the bottom wall 82, the plurality of inserting plates 822 are inserted into and matched with one-to-one correspondence with the plurality of slots 212. Thus, staggered-tooth guide areas S1/S2 linked may guide the paper currency to be pressed into the storage space by the pressing plate 11 to move on the sliding plate 21 smoothly, which avoids the paper currency being jammed between the sliding plate 21 and the partition 86. In the embodiment, the slot 212 is provided on the sliding plate 21, and the inserting plate 822 is provided on the bottom wall 82. Wherein, along the height direction of the paper currency, the height of the inserting plate 822 on the bottom wall 82 is lower than that of the sliding plate 21, thus avoiding the end face of the paper currency contacting the bottom wall 82, thereby further reducing the frictional force caused when the paper currency is stacked.

In the disclosure, the guide structure for guiding the paper currency to move smoothly is provided between the sliding plate 21 and the bottom wall 82, thus guiding the paper currency to move onto the sliding plate 21 smoothly when the paper currency is pressed into the storage space by the pressing plate 11, and basically eliminating paper currency jamming.

A working process of the cashbox provided by the disclosure will be described below.

Figure 6:
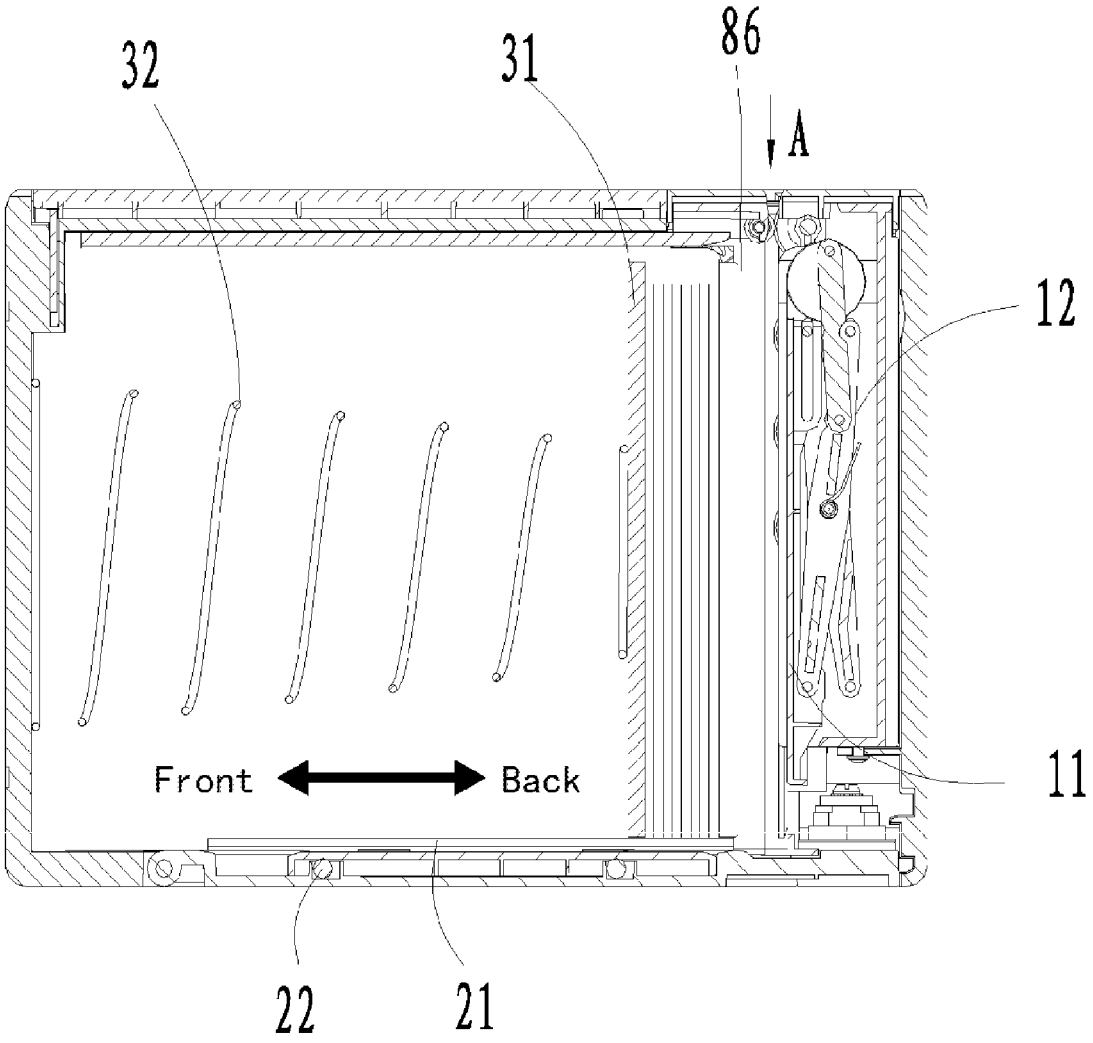
FIG. 6 is a structural axonometric view of a cashbox in a waiting state according to an embodiment of the disclosure.

When the cashbox is in a waiting state, as shown in FIG. 6, the pressing plate 11 is located in the temporary storage space, opposite to the partition 86 and spaced apart at a predetermined distance.

When the cashbox is in a currency pressing state, as shown in FIG. 3, the paper currency enters between the pressing plate 11 and the partition 86 through the inlet A, the driving assembly 12 drives the pressing plate 11 to pass through the opening 861 on the partition 86 and then enter the storage space. At the same time, the paper currency is pressed into the storage space through the opening 861, and the pressing plate 11 presses the paper currency on the supporting plate 31. When the amount of the paper currency stacked on the sliding plate 21 is fewer, the contact area between the end face of the paper currency and the sliding plate 21 is small and the paper currency is light. Therefore, the sliding frictional force between the paper currency and the sliding plate 21 is smaller. When the sliding frictional force is less than the rolling frictional force between the sliding plate 21 and the rolling body 221, the paper currency moves in the pressing direction of the pressing plate 11 relative to the sliding plate 21 along with the supporting plate when the pressing plate 11 presses the currency. As the paper currency is pressed into the cashbox one by one, the amount of the paper currency stacked on the sliding plate 21 is increased. The contact area between the end face of the paper currency and the sliding plate 21 and the weight of the paper currency are increased gradually. The sliding frictional force between the paper currency and the sliding plate 21 is increased gradually. When the sliding frictional force between the end face of the paper currency and the sliding plate 21 is greater than the rolling frictional force between the sliding plate 21 and the rolling body 221, the paper currency stays still relative to the sliding plate 21 as the pressing plate 11 presses continuously, while the sliding plate 21 supports the paper currency to move along the pressing direction of the pressing plate 11 relative to the rolling body 221.

After the pressing plate 11 of the currency pressing assembly 1 completes the currency pressing operation, the driving assembly 12 drives the pressing plate return to the temporary storage space. At this time, under the action of the elastic element 32, the supporting plate 31 presses the paper currency to move in the direction close to the partition 86. When the amount of the paper currency stacked on the sliding plate 21 is fewer, the contact area between the end face of the paper currency and the sliding plate 21 is small and the weight of the paper currency is light. Therefore, the sliding frictional force between the paper currency and the sliding plate 21 is smaller. When the sliding frictional force between the paper currency and the sliding plate 21 is less than the rolling frictional force between the sliding plate 21 and the rolling body 221, the paper currency moves in the direction close to the partition 86 relative to the sliding plate 21 until being pressed onto the partition 86. As the paper currency is pressed into the cashbox one by one, the amount of the paper currency stacked on the sliding plate 21 is increased gradually. Since the contact area between the end face of the paper currency and the sliding plate 21 and the weight of the paper currency are increased gradually, the sliding frictional force between the paper currency and the sliding plate 21 is also increased gradually. When the sliding frictional force between the paper currency and the sliding plate 21 is greater than the rolling frictional force between the sliding plate 21 and the rolling body 221, the paper currency stays still relative to the sliding plate 21, while the sliding plate 21 supports the paper currency to move in the direction close to the partition 86 relative to the rolling body 221.

The cashbox provided by the disclosure includes a box body, a currency pressing assembly, a sliding plate assembly, and a supporting plate assembly. Wherein, an inlet is provided on the surface of the box body, the partition is provided inside the box body for separating the inner space of the box body into the storage space and the temporary storage space. The inlet of the cashbox is communicated with the temporary storage space. The currency pressing assembly is provided in the temporary storage space. The pressing plate of the currency pressing assembly may pass through the opening on the partition and enter the storage space so as to press the paper currency from the inlet into the storage space. The sliding plate assembly is provided at the bottom of the storage space, includes a sliding plate and rolling bodies, wherein the sliding plate is configured to support the stacked paper currency and may move along a stacking direction of the paper currency, and rolling bodies are configured to support the sliding plate. The supporting plate assembly is located inside the storage space for pressing the paper currency pressed by the pressing plate onto the pressing plate or the partition closely. When the sliding frictional force between the end face of the paper currency and the sliding plate is less than the rolling frictional force between the sliding plate and the rolling body, the paper currency moves relative to the sliding plate while the sliding plate stays still relative to the rolling body. When the sliding frictional force between the end face of the paper currency and the sliding plate is greater than the rolling frictional force between the sliding plate and the rolling body, the paper currency stays still relative to the sliding plate while the sliding plate supports the paper currency to move along the stacking direction of the paper currency relative to the rolling body.

Compared with that the stacked paper currency always slides relative to the bottom in the prior art, in the disclosure, through the rolling body being provided below the sliding plate supporting the stacked paper currency, when the sliding frictional force of the paper currency relative to the sliding plate is greater than the rolling frictional force between the sliding plate and the rolling body, the paper currency stays still relative to the sliding plate while the sliding plate supports the paper currency to move along the stacking direction of the paper currency relative to the rolling body, the sliding friction between the paper currency and the sliding plate during the currency pressing process is converted into a rolling friction, so that the load of the driving assembly of the currency pressing assembly is reduced and the currency pressing reliability is improved.

Figure 7:
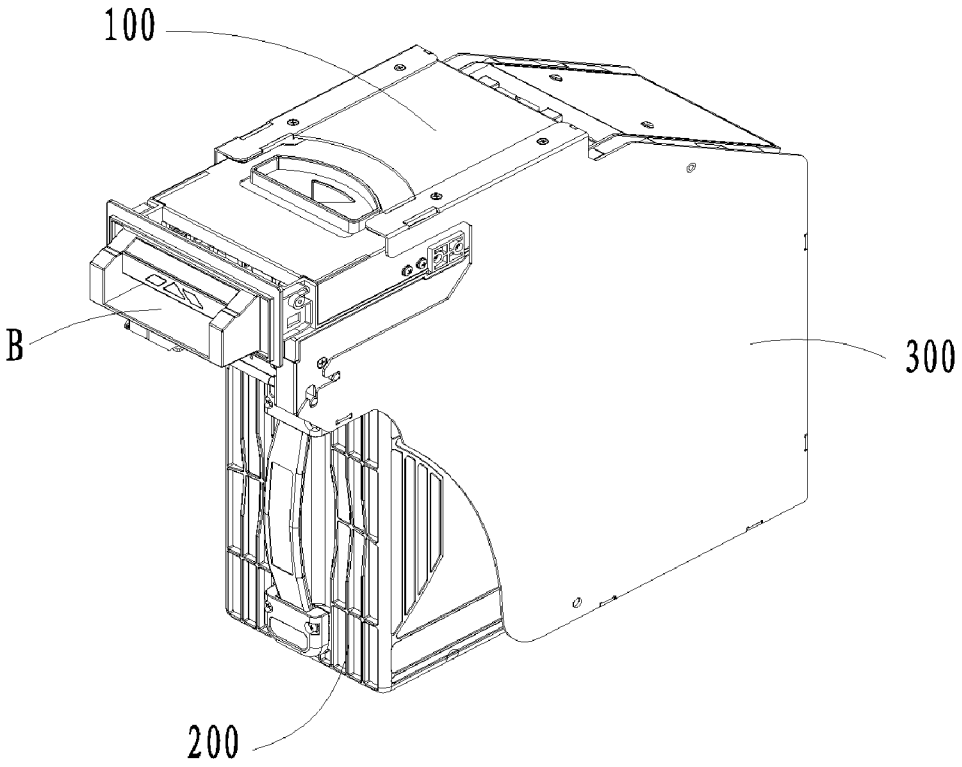
FIG. 7 is a structural axonometric view of a money validator according to an embodiment of the disclosure.

FIG. 7 is a structural axonometric view of a money validator according to an embodiment of the disclosure. As shown in FIG. 7, the money validator includes a currency recognition mechanism 100, a cashbox 200, and a frame 300.

Figure 8:
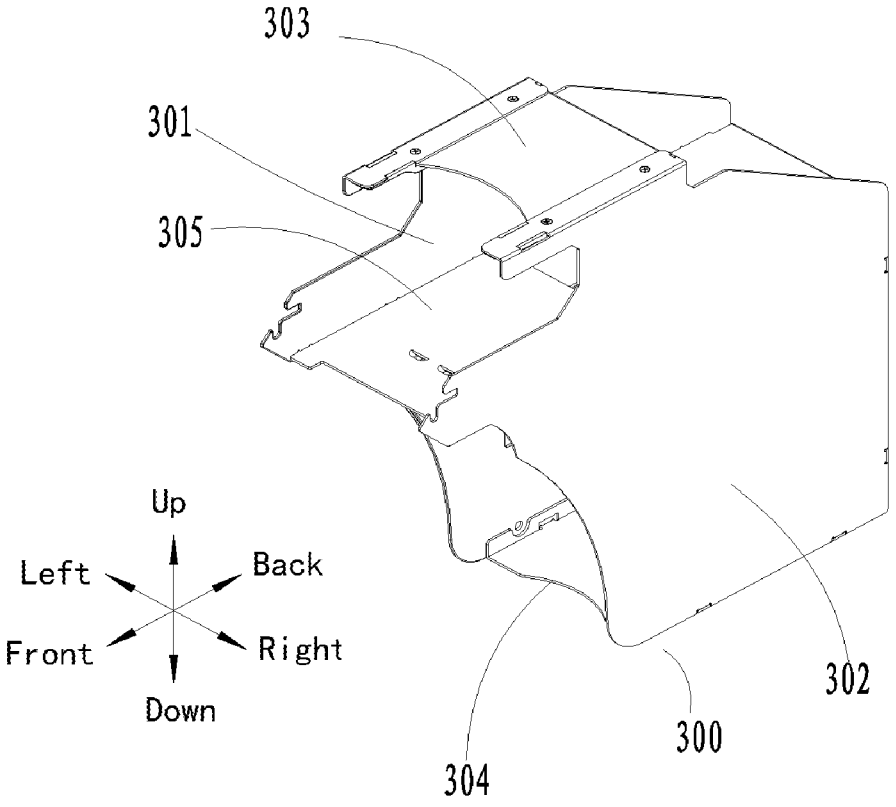
FIG. 8 is a structural axonometric view of a frame of a money validator according to an embodiment of the disclosure.

FIG. 8 is a structural axonometric view of a frame of a money validator according to an embodiment of the disclosure. As shown in FIG. 8, the frame 300 includes a left side wall 301, a right side wall 302, a top wall 303, a base plate 304, and an intermediate partition 305, wherein the left side wall 301 and the right side wall 302 are parallel to each other and spaced apart at a predetermined distance, the top wall 303 and the base plate 304 are parallel to each other and vertically supported between the left side wall 301 and the right side wall 302, and the intermediate partition 305 is parallel to the top wall 303 and the base plate 304, and the intermediate partition 305 is spaced apart at a predetermined distance from the top wall 303 and the base plate 304.

The currency recognition mechanism 100 is fixedly connected with the frame 300, and located between the top wall 303 and the intermediate partition 305, as well as between the left side wall 301 and the right side wall 302. The front end of the currency recognition mechanism 100 is provided with an inlet B communicated with the outside. The bottom of the currency recognition mechanism 100 is provided with an outlet (not shown in the figures). The paper currency enters the inside of the currency recognition mechanism 100 from the inlet B of the currency recognition mechanism 100, the genuine currency determined by recognition is fed into the cashbox by the outlet and stored, but the forged currency is discharged from the money validator via the inlet B.

The cashbox 200 is fixedly connected with the frame 300, and located between the base plate 304 of the frame 300 and the intermediate partition 305, as well as between the left side wall 301 and the right side wall 302. The upper surface of the top wall 81 of the cashbox 200 fits the lower surface of the intermediate partition 305 of the frame 300. The left side wall and the right side wall 83 of the cashbox fit the left side wall 301 and the right side wall 302 of the frame 300 respectively. The lower surface of the bottom wall 82 of the cashbox 200 fits the upper surface of the base plate 304 of the frame 300. The inlet A on the top wall 81 of the cashbox 200 is communicated with an opening (not shown in the figures) on the intermediate partition 305 through which the outlet of the currency recognition mechanism 100 passes. The paper currency which is validated as genuine currency, through the outlet of the currency recognition mechanism 100, passes through the opening provided on the intermediate separate 305 and enters the cashbox 200 from the inlet A of the cashbox. The specific structure and working principle of the cashbox 200 are as described in the above embodiments and not repeated herein.

By means of the cashbox provided by the disclosure, the money validator in the embodiment converts the sliding friction into the rolling friction between the paper currency and the sliding plate during currency pressing process, so that the load of the driving mechanism of the currency pressing assembly is reduced and the reliability of the device is improved.

It should be noted that, in above embodiments, the rolling body between the sliding plate and the bottom wall is used to convert the sliding friction into the rolling friction. In other embodiments, the rolling body may be replaced by the ball or a bearing with a smaller diameter etc., so as to implement the conversion from the sliding friction in the rolling friction.

The above are only the preferred embodiment of the disclosure and are not intended to limit the disclosure, for those skilled in the art, various changes and variations may be made to the disclosure. Any modifications, equivalent replacements, improvements and the like within the spirit and principle of the disclosure shall be contained within the scope of protection of the claims of the disclosure.

What is claimed is:

1. A cashbox, comprising:

a box body;

a partition for separating an inner space of the box body into a storage space and a temporary storage space that are arranged horizontally;

a supporting plate assembly located inside the storage space;

a currency pressing assembly for pressing a paper currency in the temporary storage space into the storage space;

a sliding plate assembly located inside the storage space for supporting the paper currency, wherein the sliding plate assembly comprises a sliding plate, and a plurality of rolling bodies located between the sliding plate and a bottom wall of the box body, and wherein the sliding plate is configured to be in contact with an end face of the paper currency and move back and forth along a stacking direction of the paper currency; and a plurality of guide structures linked up with each other for transiting the paper currency, the plurality of guide structures provided between the sliding plate and the bottom wall.

2. The cashbox according to claim 1, wherein the guide structures comprise a plurality of slots arranged at one end of the sliding plate, and a plurality of inserting plates provided on the bottom wall and capable of being inserted into and matched in one-to-one correspondence with the plurality of slots.

3. The cashbox according to claim 1, wherein:

the supporting plate assembly comprises a supporting plate, and an elastic element partially pressing the supporting plate toward the partition; and the currency pressing assembly comprises a pressing plate, and a scissors type driving assembly for driving the pressing plate, wherein an opening for the pressing plate to pass through is provided on the partition.

4. The cashbox according to claim 1, wherein one of the sliding plate and the bottom wall is provided with a limit guide groove extending along the stacking direction of the paper currency, and the other of the sliding plate and the bottom wall is provided with a guide post inserted into and matched with the limit guide groove.

5. The cashbox according to claim 4, wherein the guide post is provided with a screw which limits a position of the sliding plate relative to the bottom wall.

6. The cashbox according to claim 1, wherein the bottom wall is a box door of the box body which can be opened or closed, and the sliding plate assembly is always kept on the box door.

7. The cashbox according to claim 1, wherein the rolling bodies are balls or rollers, and the bottom wall is provided with bases for accommodating the balls or rollers.

8. A money validator, comprising a frame, a currency recognition mechanism and a cashbox supported on the frame, wherein the cashbox is a cashbox according to claim 1.

9. The money validator according to claim 8, wherein the frame comprises a left side wall, a right side wall, a base plate located between the left side wall and the right side wall, an intermediate partition, and a top wall, the currency recognition mechanism is provided between the top wall and the intermediate partition, and the cashbox is provided between the base plate and the intermediate partition.

10. The money validator according to claim 8, wherein a plurality of guide structures linked up with each other for transiting the paper currency are provided between the sliding plate and the bottom wall.

11. The money validator according to claim 10, wherein the guide structures comprise a plurality of slots arranged at one end of the sliding plate, and a plurality of inserting plates provided on the bottom wall and capable of being inserted into and matched in one-to-one correspondence with the plurality of slots.

12. The money validator according to claim 8, wherein:

the supporting plate assembly comprises a supporting plate, and an elastic element partially pressing the supporting plate toward the partition; and the currency pressing assembly comprises a pressing plate, and a scissors type driving assembly for driving the pressing plate, wherein an opening for the pressing plate to pass through is provided on the partition.

13. The money validator according to claim 8, wherein one of the sliding plate and the bottom wall is provided with a limit guide groove extending along the stacking direction of the paper currency, and the other of the sliding plate and the bottom wall is provided with a guide post inserted into and matched with the limit guide groove.

14. The money validator according to claim 13, wherein the guide post is provided with a screw which limits the position of the sliding plate relative to the bottom wall.

15. The money validator according to claim 8, wherein the bottom wall is a box door of the box body which can be opened or closed, and the sliding plate assembly is always kept on the box door.

16. The money validator according to claim 8, wherein the rolling bodies are balls or rollers, and the bottom wall is provided with bases for accommodating the balls or rollers.

* * * * *